United States Patent [19]

Hill, Sr.

[11] Patent Number: 4,759,166

[45] Date of Patent: Jul. 26, 1988

[54] ROOF PANEL

[76] Inventor: James R. Hill, Sr., 8261 Brackridge Blvd. South, Jacksonville, Fla. 32216

[21] Appl. No.: 55,014

[22] Filed: May 28, 1987

[51] Int. Cl.[4] ..... E04D 1/36

[52] U.S. Cl. ..... 52/531; 52/519

[58] Field of Search ..... 52/531, 533, 519

[56] References Cited

U.S. PATENT DOCUMENTS

| | | | |
|---|---|---|---|
| 2,148,434 | 2/1939 | Calkins et al. | 52/531 |
| 3,135,070 | 6/1964 | Waring et al. | 52/531 X |
| 3,495,363 | 2/1970 | Johnson | 52/531 X |

*Primary Examiner*—J. Karl Bell

*Attorney, Agent, or Firm*—Arthur G. Yeager

[57] ABSTRACT

A building panel which can be fabricated on site to any desired length, comprising a continuous strip having two mutually interlocking edge structures running the full length of the panel, one edge structure being adapted to be fastened to the underlying roof and including an outer flange with spaced slots through which a nail or screw can be used to fasten the panel, an upwardly projecting lengthwise first ridge with a rounded upper portion, an S-shaped recess spaced inwardly from the first ridge and running lengthwise of the panel, and the other edge structure including an outer flange adapted to be inserted into the S-shaped recess of the next adjacent panel, and an upwardly projecting lengthwise second ridge adapted to overlie the first ridge of the next adjacent panel.

9 Claims, 1 Drawing Sheet

ROOF PANEL

BACKGROUND OF THE INVENTION

Although metal sheeting has been used to cover the outside of industrial buildings for many years, it is only in the recent few years that metal panels have found widespread use in covering the sides and roofs of all types of buildings, whether residential, industrial, business or governmental. Not only has the paneling become more aesthetically appealing, but machinery has been developed to manufacture the paneling on the building site to fit any length required.

The paneling of the prior art has suffered from either or both of two major problems; namely, (1) the paneling has not been rainproof, and (2) the assembly and fastening of the paneling to the building has involved the use of separate clips. It is believed that the present invention has, for the first time, solved both of these problems satisfactorily.

It is an object of this invention to provide a novel building panel. It is another object of this invention to provide a new building panel which does not employ clips in its assembly, and which does not leak in a normal rainstorm. Still other objects will appear in the more detailed description which follows.

BRIEF SUMMARY OF THE INVENTION

This invention relates to a building panel of selected length and having two cooperating, parallel, interlocking edge structures. The first edge structure having along its outer edge a lengthwise first flange with lengthwise spaced slotted passageways through the panel adapted to receive the shank of a fastening device for attaching said panel to the understructure of the roof an upwardly projecting lengthwise first ridge adjacently parallel to said flange, and a return bend recess adjacently parallel to said first ridge and a second edge structure having along its outer edge a lengthwise second flange adapted to be inserted into said return bend recess and parallel thereto an upwardly projecting lengthwise second ridge adapted to overlie said first ridge.

In specific embodiments of this invention the second ridge may assume any of several shapes which are large enough to lie over the first ridge without touching any of the upwardly projecting portions thereof.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
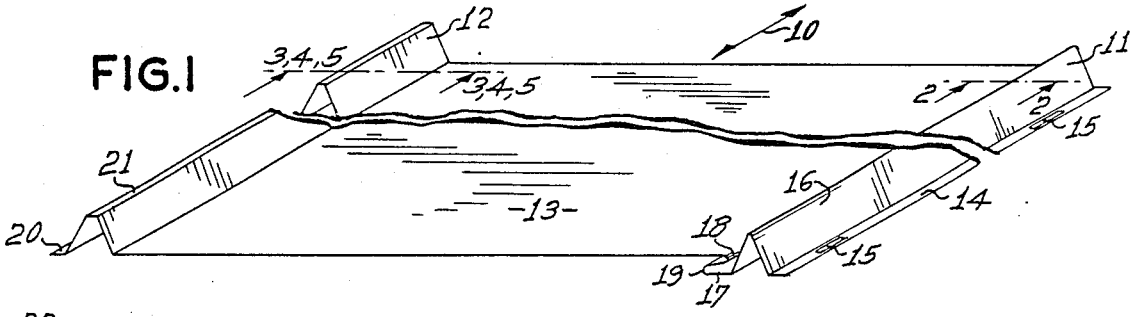
FIG. 1 is an overall view in perspective of the panel of this invention.

The features and operation of this invention can best be understood by reference to the attached drawings.

The panel of this invention may be used as roofing or siding in a building. The panel has any selected length but has two specially formed edge structures running the full length of each panel. The first edge structure 11, the second edge structure 12 and the central flat portion 13 of the panel extend longitudinally in the direction 10 for any selected distance. First edge structure 11 is fastened down to the underneath structure of the building and second edge structure 12 (of the next adjacent panel) is interlocked to the first edge structure 11 without the use of any clips or fasteners. In this way, only one edge of each panel is actually fastened down.

First edge structure 11 includes an outer edge flange 14 which lies against the underneath building material, whether it be roofing, siding, or internal structure. Flange 14 has longitudinally spaced passageways 15, preferably slotted to permit a certain amount of longitudinal adjustment, through which a nail or a screw is fastened to the understructure. Adjacent to outer flange 14 is an upwardly projecting first ridge 16 in the form of an inverted V with the apex of the V rounded. Next to ridge 16 is an inner flange 17 which is approximately the same width as outer flange 14. At the inner end of flange 17 is an S-bend joining the central portion 13 of the panel to inner flange 17. The purpose of the S-bend portion 18 is to provide a recess 19 which is part of the system interlocking two adjacent panels to each other.

On the other edge of the panel is second edge structure 12 which includes an outer edge flange 20 and an upwardly projecting second ridge 21 that extends longitudinally the full length of the panel. Flange 20 is inserted into recess 19 and then lies flat against inner flange 17 and so it is important that outer flange 20 be slightly narrower than the width of inner flange 17. With flange 20 inserted into recess 19 second ridge is then positioned to overlie first ridge 16.

Figure 2:
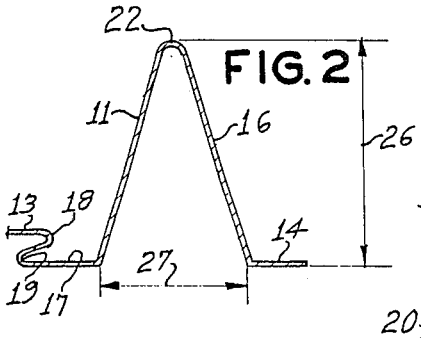
FIG. 2 is a cross sectional view taken at 2—2 of FIG. 1.

The general shapes of edge structures 11 and 12 are shown in enlarged drawings of FIGS. 2–5 showing the cross sections of structures 11 and 12. In all embodiments of the panels the shape of first edge structure 11 may be the same since in the final assembly this structure is covered and cannot be seen from the outside. First edge structure 11 is shown in FIG. 2 to include an outer edge flange 14, a first ridge 16, an inner flange 17, and an S-bend portion 18. The particular shape of ridge 16 shown here is that of an inverted V with the apex 22 of the V rounded. The ridge has a width 27 at its lower open end and a height 26 from flange 14 to apex 22. It is not critical that this particular shape be employed for first ridge 16. Any other convenient shape is operable. The height 26 must be enough to function as a dam against rain water flowing over the top from central portion 13. Generally, a height 26 of at least 0.75 inch is satisfactory for sloped roofs, while a high figure might be recommended for flatter roofs with little or no slope. Whatever shape and size is chosen for first edge structure 11 it may be identical for any particular job regardless of the shapes chosen for second edge structure 12.

Figure 3:
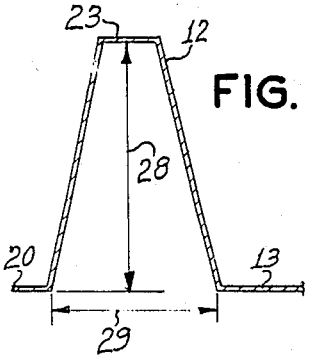
FIG. 3 is a cross sectional view of one embodiment taken at 3—3 of FIG. 1.
Figure 4:
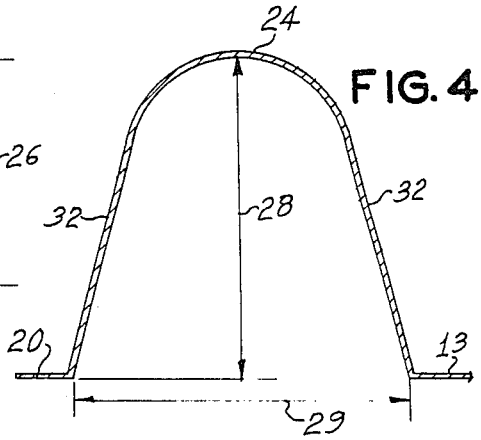
FIG. 4 is a cross sectional view of a second embodiment taken at 3—3 of FIG. 1.
Figure 5:
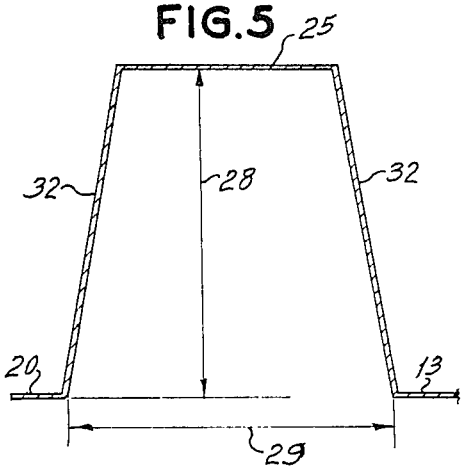
FIG. 5 is a cross sectional view of a third embodiment taken at 3—3 of FIG. 1.

Second edge structure 12 must be designed in size and shape to overlie first edge structure 11. The outer shape of second edge structure 12 may be varied to suit the taste and desires of the user. Three such shapes are shown in FIGS. 3–5. In FIG. 3 the shape is similar to that of FIG. 2 except apex 23 is flat rather than rounded as in FIG. 2. In FIG. 4 the shape is more like an inverted V with a rounded bottom 24 and sloping sides 32. In FIG. 5 the shape is similar to that of FIG. 4 except the bottom 25 is flat while sides 32 remain sloped as in FIG. 4. These are only a few of the possible shapes that are operable. In each of the shapes shown in FIGS. 3–5, the ridge has a width 29 at its open end and an inside height 28. It is important that width 29 be larger than width 27 of first ridge of FIG. 2 and it is important that height 28 be larger than height 26 of first ridge of FIG. 2, because in use, second ridge 12 (FIGS. 3–5) must overlie and completely cover first ridge 11 (FIG. 2).

Figure 6:
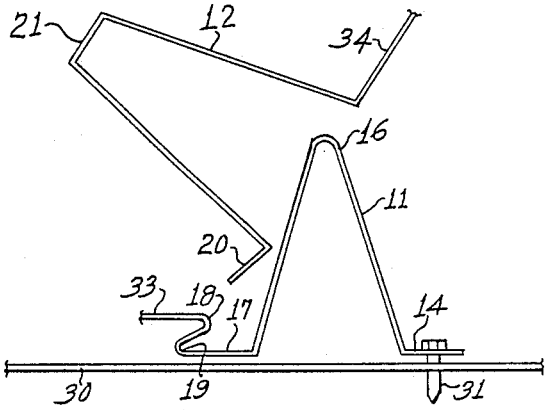
FIG. 6 is a schematic view showing the first step in assembling and interlocking two panels of this invention.
Figure 7:
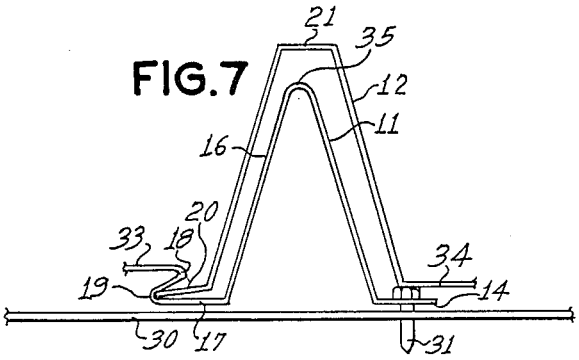
FIG. 7 is a schematic view showing two panels in an interlocked position.

In FIGS. 6–7 there is shown the manner in which adjacent panels 33 and 34 are interlocked by joining first edge structure 11 of panel 33 to the second edge structure 12 of the next adjacent panel 34. Panel 33 is fastened to the understructure 30 of a building by a plurality of screws 31. The next panel 34 is attached by inserting flange 20 of panel 34 into recess 19 of panel 33 and then positioning second ridge 12 of panel 34 over first ridge 11 of panel 33. This covers screw fasteners 31 from any possibility of rain leaking into the understructure 30, because in order for that to happen the rain must build up to a depth greater than the height of apex 35 above the central portions of panels 33 and 34. Such a buildup would not be found on sloping roofs or on vertical siding. The tolerances between flange 20 and recess 19 are considerably closer than shown in FIGS. 6 and 7 which are merely illustrative so as to show the principle of joining panels. Actually the fit is somewhat tight so as to produce a juncture that will not come apart except when a worker is intent upon separating panels.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A building panel of selected length and having two cooperating, parallel, interlocking edge structures, the first edge structure having along its outer edge a lengthwise first flange with lengthwise spaced slotted passageways through the panel adapted to receive the shank of a fastening device for attaching said panel to the understructure of the roof, and upwardly projecting lengthwise first ridge adjacently parallel to said flange, and spaced away from said first ridge a return bend recess adjacently parallel to said first ridge and a second edge structure having along its outer edge a lengthwise outwardly extending second flange adapted to be inserted into said return bend recess and parallel and spaced inwardly therefrom an upwardly projecting lengthwise second ridge adapted to overlie said first ridge.

2. The panel of claim 1 wherein said first ridge has an inverted V-shape with the apex of said V being rounded.

3. The panel of claim 1 wherein said second ridge has an inverted V-shape with the apex of said V being flattened.

4. The panel of claim 1 wherein said second ridge has an inverted V-shape.

5. The panel of claim 1 wherein said second ridge has an inverted V-shape with the normally rounded bottom of the V being flattened.

6. A building panel generally elongated rectangular in shape with two elongated parallel mutually interlocking edge structures extending the full length of said panel, the first edge structure having an outer longitudinal edge flange with longitudinally spaced slotted passageways therethrough for a screw or nail to fasten the panel to the roof structure underneath said panel, inwardly adjacent to said flange an upwardly projecting first ridge having an inverted V-shape with the apex of the V being rounded, inwardly adjacent to said first ridge an inward flange terminating in an S-bend recess spaced apart from said first ridge; and the second edge structure having an outer longitudinal edge flange adapted to be inserted into said S-bend recess and lie flat against said inward flange and inwardly adjacent to said outer edge flange an upwardly projecting second ridge adapted to overlie said first ridge.

7. The panel of claim 6 wherein said second ridge has an inverted V-shape with the apex of said V being flat.

8. The panel of claim 6 wherein said second ridge has an inverted V-shape.

9. The panel of claim 6 wherein said second ridge has an inverted V-shape with the normally rounded bottom of said V being flat.

* * * * *